US006629494B2

(12) United States Patent
Imanishi

(10) Patent No.: US 6,629,494 B2
(45) Date of Patent: Oct. 7, 2003

(54) SLIDE DRIVING DEVICE FOR A PRESS MACHINE

(75) Inventor: Shozou Imanishi, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 83 days.

(21) Appl. No.: 09/785,029

(22) Filed: Feb. 16, 2001

(65) Prior Publication Data

US 2001/0020421 A1 Sep. 13, 2001

(30) Foreign Application Priority Data

Feb. 22, 2000 (JP) ..... 2000-044574

(51) Int. Cl.[7] ..... B30B 1/10
(52) U.S. Cl. ..... 100/286; 100/282; 72/451
(58) Field of Search ..... 100/257, 282, 100/283, 285, 286, 280; 72/450, 451, 452.1, 452.2, 452.3, 452.4, 452.5; 74/604

(56) References Cited

U.S. PATENT DOCUMENTS

| | | | | |
|---|---|---|---|---|
| 3,808,912 A | * | 5/1974 | Voorhees et al. | 100/282 |
| 4,630,516 A | | 12/1986 | Koch et al. | 83/530 |
| 4,817,456 A | * | 4/1989 | Imanishi et al. | 100/282 |
| 5,287,728 A | * | 2/1994 | Yoshida | 74/38 |
| 5,848,568 A | * | 12/1998 | Imanishi | 100/257 |

FOREIGN PATENT DOCUMENTS

| | | | | |
|---|---|---|---|---|
| JP | 08 118082 | | 5/1996 | B30B/1/14 |
| JP | 10 099995 | | 4/1998 | B30B/1/14 |
| JP | 10128596 | * | 5/1998 | |
| JP | 1099995 | * | 3/1999 | |
| JP | 10099995 | * | 3/1999 | |
| JP | 11 197888 | | 7/1999 | B30B/1/14 |
| JP | 11 320187 | | 11/1999 | B30B/1/14 |

* cited by examiner

*Primary Examiner*—Allen Ostrager
*Assistant Examiner*—Shelley Self
(74) *Attorney, Agent, or Firm*—Darby & Darby

(57) ABSTRACT

A slide driving device for a press machine is driven by a first and second upper toggle link mechanisms pivotably mounted above a slide. The upper toggle links include first links connected at a connecting link along a common tangent line. The connecting link is driven by a connecting rod receiving eccentric movement from a crank shaft. The upper toggle links also include second links, each connected to lower toggle links. The lower toggle links operate a plunger and drive a slide. Alternative embodiments allow adaptive positions of the upper toggle links and crank shaft along with multiple lengths for the first and second links. A dynamic balancer, is not necessary for operation, but may be added to minimize vibration. Together, these embodiments provide a slide driving device with minimized vibration and simplified construction.

16 Claims, 7 Drawing Sheets

SLIDE DRIVING DEVICE FOR A PRESS MACHINE

BACKGROUND OF THE INVENTION

1. Field of the Invention

The present invention relates to a slide driving device driven by a toggle link mechanism. The present invention also relates to a slide driving device that is small and efficiently operates at high speed in a two point press machine.

2. Description of the Related Art

Japanese Laid-Open Patent Number 8-118082 is an example of a press machine in the related art. The press machine has a simplified construction. The press machine has adjustable speed. Further, fluctuation of a bottom dead center position, due to an inertial force of a slide, is minimized.

However in the above example, to maintain the parallelism of the slide, ball bearings are needed on both ends of a link pin. The ball bearings necessitate linear guide grooves to guide the ball bearings in operation. The clearance of the ball bearings and the guide grooves affects the parallelism of the slide. Further, with a three dimensional configuration, the lateral balance of the press machine is complicated. Such a design requires three connecting rods arranged in a left-right direction. The three connecting rods require three locations for eccentric parts on an operating crank shaft, thereby increasing complexity.

OBJECT AND SUMMARY OF THE PRESENT INVENTION

It is an object of the present invention to provide a slide driving device for a press machine.

It is another object of the present invention to provide a slide driving device where the construction has a minimum number of parts and high precision is easily obtained.

It is another object of the present invention to provide a two point press machine driven by a simple toggle link mechanism.

It is another object of the present invention to provide a sliding device for a press machine where a toggle link mechanism is bent in a left-right direction.

It is another object of the present invention to provide a press machine where the parallelism of the slide can be easily maintained.

It is another object of the present invention to provide a press machine where the vibration of operation may be substantially suppressed.

It is another object of the present invention to provide a press machine where the motion of a connecting rod is minimized.

It is another object of the present invention to provide a press machine where the construction and height may be adjusted to maximize stability and minimize the spacing between multiple plungers.

Briefly stated the present invention relates to a slide driving device for a press machine driven by a first and second upper toggle link mechanisms pivotably mounted above a slide. The upper toggle links include first links connected at a connecting link on a common tangent line. The connecting link is driven by a connecting rod receiving eccentric movement from a crank shaft. The upper toggle links also include second links each connected to lower toggle links. The lower toggle links operate a plunger to drive a slide. Alternative embodiments allow multiple positions of the upper toggle links and crank shaft along with multiple lengths for the first and second links. A dynamic balancer may be added to the upper toggle links to minimize vibration. Together, these embodiments provide a slide driving device with minimized vibration and simplified construction.

In this invention, by forming a modified type of Watt-link mechanism on the left and right driving branching parts, the parallelism of the slide can be maintained by only having one connecting link to connect between first support point pins of the left and right upper toggle links. In addition, there only needs to be one connecting rod, and ball bearings and guide grooves are unnecessary. Because there are only pin connections between the links, there are very few construction parts, and high precision is easily achieved.

According to an embodiment of the present invention, there is provided: A slide driving device comprising: at least first and second upper toggle means, a rotation center on each of the first and second upper toggle means, each of the first and second upper toggle means rotatable in an arc, a first point pin on each first and second upper toggle means, a first link connects each rotation center to each respective first point pin, a connecting link connects the first and second upper toggle means at the first point pins on a common inner tangent line to each arc where the first links are parallel, the connecting link transfers a guiding displacement to the first and second upper toggle means, a first and second plunger drive a slide in a displacement cycle, the first and second plungers operably connect to the first and second upper toggle means, and the first and second upper toggle means transfer the guiding displacement to the plungers and the slide operates through the displacement cycle whereby the slide driving device operates According to another embodiment of the present invention, there is provided: a slide driving device further comprising: a crank shaft having at least a first eccentric part, the first eccentric part having an eccentric displacement, a connecting rod connects the first eccentric part to the connecting link, and the connecting rod operably transfers the eccentric displacement to the connecting link whereby the slide operates through the displacement cycle.

According to another embodiment of the present invention, there is provided a slide driving device further comprising: a second point pin on each the first and second upper toggle means, a second link connects each of the rotation center to each respective second point pin, at least first and second lower toggle links, the first and second lower toggle links operably connected to respective first and second plungers, and the first and second upper toggle means operably transfer the guiding displacement through respective the second links to respective the first and second lower toggle links and the first slide whereby the slide operates through the displacement cycle.

According to another embodiment of the present invention, there is provided: a slide driving device further comprising: a first balancer on the first upper toggle means, a second balancer on the second upper toggle means, each first and second balancer has a weight and a shape adaptable to each respective first link, a third link connects each rotation center to each respective, the first and second balancer, each third link being positioned relative to each second link, and each first and second balancers positioned to minimize vibration in the slide driving device when the first and second plungers drive the slide in the displacement cycle, whereby the operating vibration of the slide driving device is minimized.

According to another embodiment of the present invention, there is provided: a slide driving device, wherein: the first upper toggle means is a first upper toggle element, the second upper toggle means is a second upper toggle element, and the first and second upper toggle elements operable to transfer the guiding displacement from the connecting link to each respective second link, whereby the slide operates through the displacement cycle.

According to another embodiment of the present invention, there is provided: a slide driving device, wherein the first, second, and third links have a similar length, the arc for each respective first and second upper toggle means has a similar radius, each rotation center above each respective plunger, each rotation center an equidistant from a common center line between the first and second upper toggle means, the crank shaft below the connection rod, and the second support pins and the first and second lower toggle links operable on first outer sides of each respective the plunger, whereby the slide operates through the displacement cycle.

According to another embodiment of the present invention, there is provided: a slide driving device, wherein: the first, second, and third links have the same length, the arc for each respective first and second upper toggle means has the same radius, each rotation center above each respective plunger, each rotation center equidistant from a common center line between the first and second upper toggle means, the crank shaft below the connection rod, and the second support pins and the first and second lower toggle links operable on an inner side of each respective plunger, whereby the slide operates through the displacement cycle.

According to another embodiment of the present invention, there is provided: a slide driving device, wherein: the first, second, and third links have the same length, the arc for each respective first and second upper toggle means has the same radius, each rotation center above each plunger, each rotation center an equal distance from a common center line between the first and second upper toggle means, the crank shaft above the connection rod, and the second support pins and the first and second lower toggle links operable on an inner side of each respective plunger, whereby the slide operates through the displacement cycle.

According to another embodiment of the present invention, there is provided: a slide driving device wherein: each rotation center is a first distance from a common center line between the first and second upper toggle means, each plunger is a second distance from the common center line, the first distance greater than the second distance, each first link longer than the second link, each second point pin operable substantially above each respective plunger and respective to the toggle link, the crank shaft above the connection rod along the common center line, and each lower toggle link and each respective plunger being substantially unitary and operable parallel to the common center line, whereby the slide operates through the displacement cycle with reduced vibration.

According to another embodiment of the present invention, there is provided: a slide driving device wherein: the rotation center is a first rotation center for the first upper toggle means, the rotation center is a second rotation center for the second upper toggle means, the first rotation center and the second rotation center at different distances above each respective plunger, the first point pins substantially tangent the common center line, and the connecting rod and the connecting link operate substantially along the common center line and minimize vibration in the slide driving device when the first and second plungers drive the slide in the displacement cycle.

According to another embodiment of the present invention, there is provided: a slide driving device comprising: first and second upper toggle elements, the first and second upper toggle elements equidistant from a common center line, the first and second upper toggle elements operable in first and second arcs, the first and second upper toggle elements joined by connecting link at an inner tangent line to the first and second arcs, first and second lower toggle elements, the first and second lower toggle elements operably joined to each respective first and second upper toggle elements, the first and second lower toggle elements drive a slide element in a displacement cycle, the common connecting link receiving a driving displacement; and the first and second upper toggle elements transmit the driving displacement to the first and second lower toggle elements, and the first and second lower toggle elements drive the slide element in the displacement cycle whereby vibration is minimized.

According to another embodiment of the present invention, there is provided: a slide driving device for a press machine, comprising: a left and a right upper toggle link each pivotably mounted onto respective fixed support point pins, the fixed support point pins equidistant from a center line between, a first support link on the left and right upper toggle links, each first support link operable in an arc, each the first support link having an equal length, a connecting link connects each the first support links along a common inner tangent line to each the arc where the first support links are parallel to each other, a connecting rod connects the connecting link to an eccentric part of a crank shaft, first and second lower toggle links connect second support point pins of the left and right upper toggle links along a second link of each the left and right upper toggle link, the second links rotatably connect the left and right lower toggle links with left and right points on a slide, and the connecting rod transmits a guiding displacement to the left and right upper toggle links, through the lower toggle links, to the slide to drive the slide through a displacement cycle.

According to another embodiment of the present invention, there is provided: a slide driving device for a press machine further comprising: a dynamic balancer are mounted to an outer end of each the left and right upper toggle links along a third link, and each the dynamic balancer has a weight and a shape selected to minimize vibration of the slide driving device.

According to another embodiment of the present invention, there is provided: a slide driving device for a press machine, further comprising: a left and right plunger upright at left and right points of the slide, first ends of the left and right plungers operably connect with the left and right lower toggle links, the left and right fixed support points horizontally equidistant from the center line above respective to the left and right plungers, the second support point pins are placed on outer sides of each of the left and right plunger, and the crank shaft is below the connecting link.

According to another embodiment of the present invention, there is provided: a slide driving device for a press machine, further comprising: left and right plungers provided upright at left and right points of the slide, first ends of each the left and right plungers connect to respective left and right lower toggle links, the left and right fixed support points equidistant from the common center line above each respective of the left and right plunger, the second support point pins placed on inner sides of each respective left and right plunger, and the crank shaft below the connecting link.

According to another embodiment of the present invention, there is provided: a slide driving device for a press machine, further comprising: left and right plungers upright at left and right points of the slide, ends of each the left and right plunger connect with each respective left and right lower toggle link, the left and right fixed support points equidistant from the center line and outward from directly above the plungers, the second support point pins on inner sides of each respective left and right plunger, and the crank shaft is placed above the connecting link.

According to another embodiment of the present invention, there is provided: a slide driving device for a press machine, further comprising: left and right plungers upright at left and right points of the slide, ends of each the left and right plunger connect with each respective left and right lower toggle link, the left and right fixed support points at first and second positions, the first and second positions above each the left and right plunger at different heights, the second support point pins on outer sides of each respective the left and right plungers, and the crank shaft is placed below the connecting link.

According to another embodiment of the present invention, there is provided: a slide driving device for a press machine, further comprising: the left and right fixed support points horizontally equidistant from the center line outward from each the left and right points of the slide, the second links perpendicular to the center line when each respective second support point pin is directly above each respective left and right points on the slide, and the crank shaft is above the connecting link.

The above, and other objects, features and advantages of the present invention will become apparent from the following description read in conjunction with the accompanying drawings, in which like reference numerals designate like elements.

DESCRIPTION OF THE PREFERRED EMBODIMENTS

Figure 1:
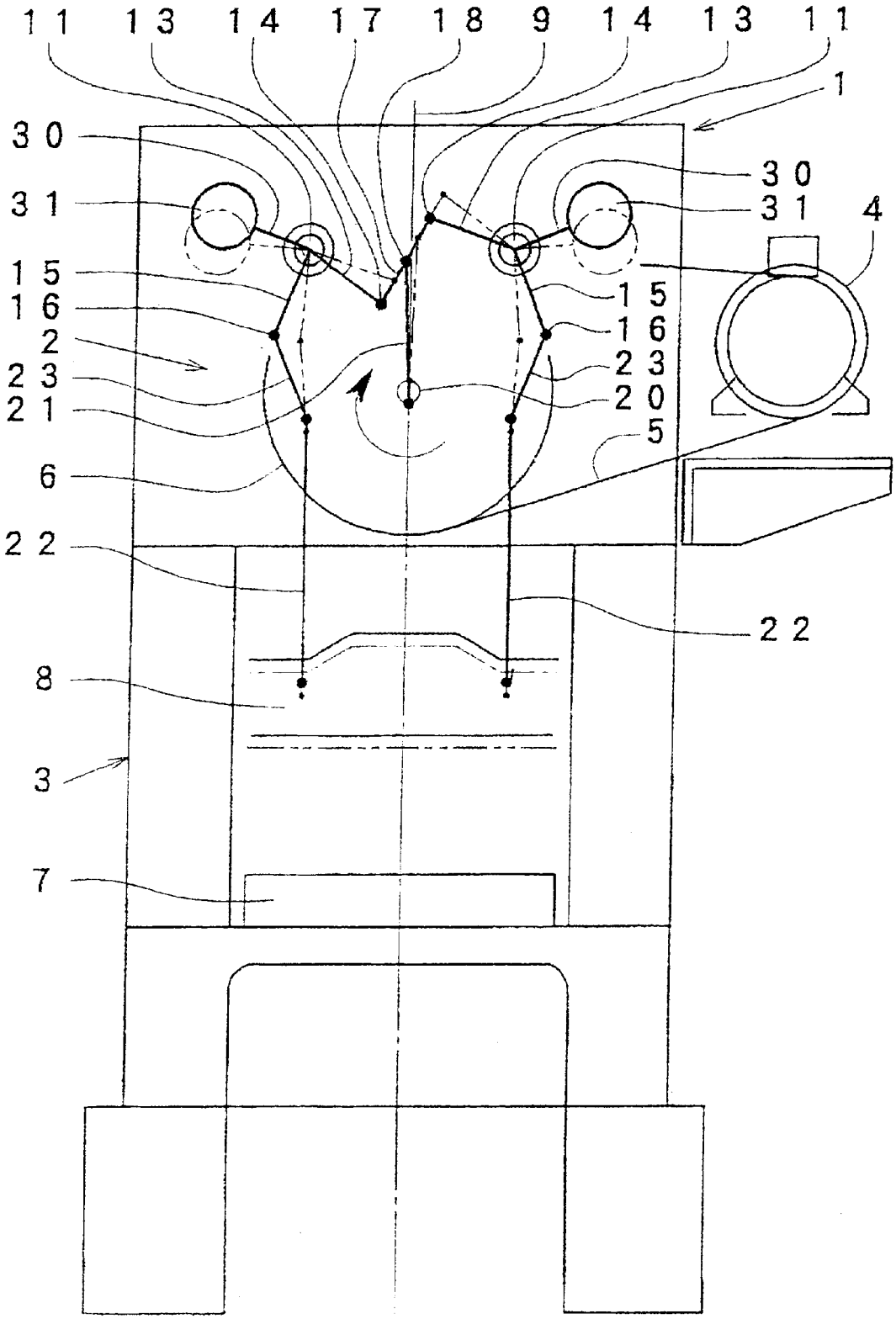
FIG. 1 is a front view of a principal construction of a press machine according to a first embodiment of the present invention.
Figure 2:
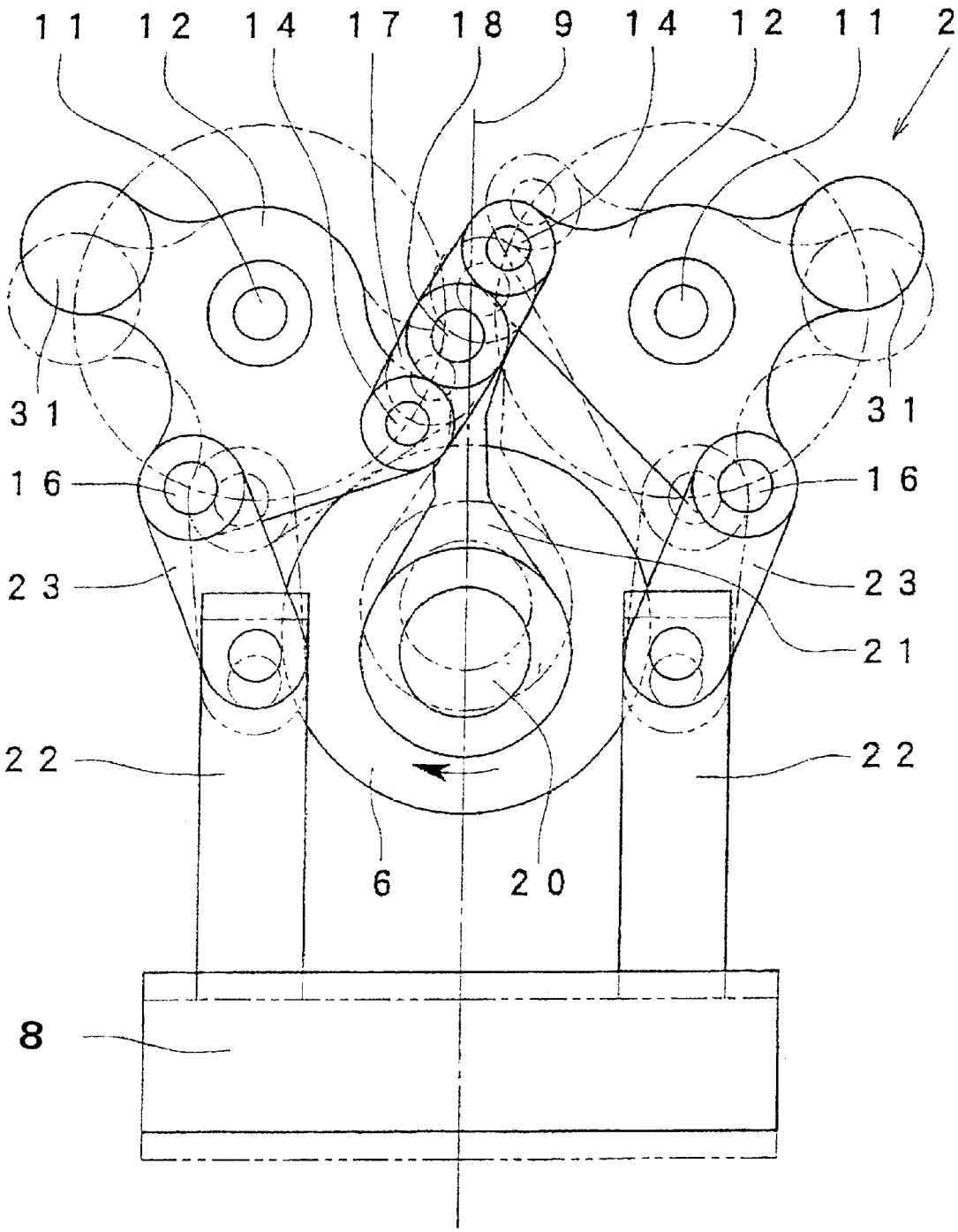
FIG. 2 is a front view of a slide driving device.
Figure 3:
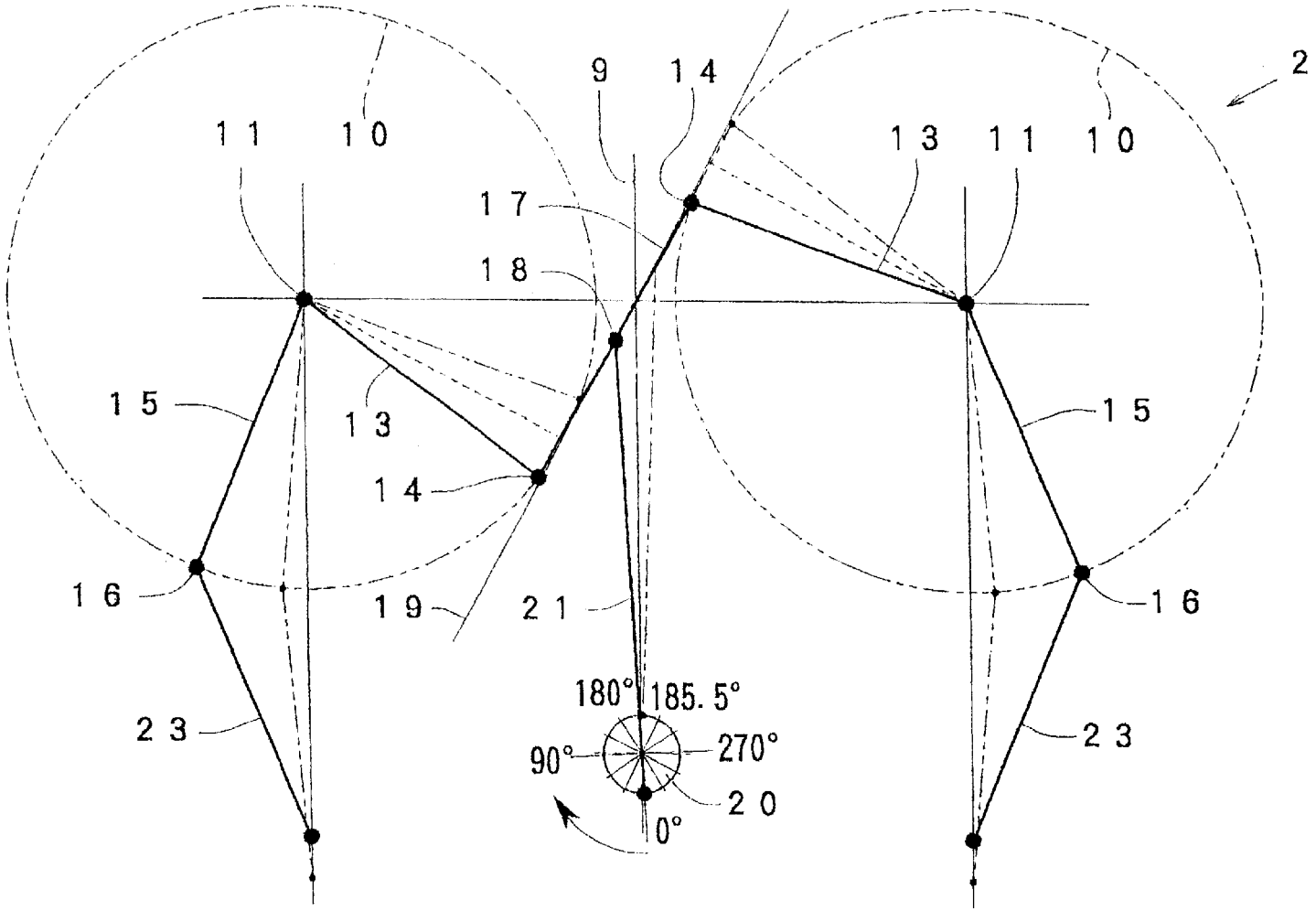
FIG. 3 is a skeleton diagram showing a line drawing of a construction of a slide driving device.

Referring to FIGS. 1 through 4, the first embodiment of a press machine 1 is shown, including a slide driving device 2 mounted to a frame 3. Slide driving device 2 operates a slide 8 through a pair of plungers 22. In FIGS. 1 through 4, the motion of slide driving device 2 and slide 8 are shown as solid and two-dashed lines. The solid line indicates when slide driving device 2 is at a top dead center, position and the two-dashed line indicates when slide driving device 2 is at a bottom dead center.

A main motor 4 rests on frame 3 of press machine 1. A belt 5 attaches a main motor 4 to a fly wheel 6. Belt 5, transmits the power from main motor 4 to fly wheel 6 through a disconnecting clutch (not shown). Fly wheel 6 rotates on a driving shaft (not shown).

A bolster 7 affixes to frame 3 below slide 8. In operation, slide 8 can be raised and lowered relative to bolster 7. In operation, an upper mold and a lower mold (both not shown) are mounted on slide 8 and bolster 7, respectively. Slide 8 and plungers 22 are both guided by guide devices(not shown) relative to bolster 7.

A pair of fixed support point pins 11 are fixed on a left and a right position on an upper part of frame 3. Fixed support point pins 11 are equidistant from a vertical surface position 9. Fixed support point pins 11 are also on the same horizontal plane. Vertical surface position 9 is in the center of the left and right positions. It is to be understood, that vertical surface 9 is a representational center surface position of slide driving device 2. It is to be further understood, that vertical surface 9 allows a positional component comparison to be made throughout the operation of slide driving device 2.

An upper toggle link 12 pivotably mounts on each fixed support point pin 11. Upper toggle link 12 includes three fixed links at predetermined first, second, and third positions. First, second, and third positions are substantially equidistant from fixed support point pin 11 on upper toggle link 12.

A first support point pin 14 is in the first position on each upper toggle link 12. A second support point pin 16 is in the second position on each upper toggle link 12. A dynamic balancer 31 is in the third position on each upper toggle link 12.

Dynamic balancer 31 includes a weight portion (not shown) that corresponds to a weight of the first link 13 portion of each upper toggle link 12.

It is to be understood, that the weight portion of dynamic balancer 31 is selected and positioned to dampen operating vibration of the slide driving device 2.

The distance from fixed support point pin 11 to first support point pin 14 is the same as the distance from fixed support pin 11 to second support point pin 16.

A first link 13, is defined between fixed support point pins 11 and first support point pins 14. A second link 15, is defined between fixed support point pins 11 and second support point pins 16. A third link 30, is defined between support point pins 11 and dynamic balancers 31. Third link 30 is perpendicular to second link 15 in an outer direction, away from vertical surface 9.

In operation, first support point pins 14, second support point pins 16, and dynamic balancers 31 move along a pair of circular arcs 10, of an equal radius (shown by dashed lines). Thus, fixed support point pins 11 are the centers of circular arcs 10.

Where left and right first support point pins 14, are both positioned at tangent points to a common inner tangent line 19, of each circular arc 10 (shown by the dashed line), the left and right first links 13 are parallel to each other. A connecting link 17 connects first links 13 in this position at first support point pins 14. At this position, connecting link 17 is at a pitch of the distance between left and right first support point pins 14.

A center support point pin 18 is at a midpoint along connecting link 17. In operation, first links 13 swing along circular arcs 10 and center support point pin 18 has an approximate linear motion along inner tangent line 29 due to the Watt-link-type mechanism. The present invention takes advantage of the fact that the swinging angles for each left and right first links 13 are approximately equal at that time.

A connecting rod 21 extends from center support point pin 18. Connecting rod 21 has a large end and a small end. The small end of connecting rod 21 rotatively connects to center support point pin 18. The large end of connecting rod 21 rotatively connects to an eccentric part (not shown) of a crank shaft 20.

Crank shaft 20 includes a shaft core (not shown) positioned in a front-back direction of the press machine.

Plungers 22, extend from left and right points on slide 8, toward fixed support point pins 11. Each plunger 22 has an upper end positioned directly below fixed support point pins 11. Second support point pins 16, of second links 15 rotatively connect the upper ends of each plunger 22 through a pair of lower toggle links 23. Lower toggle links 23 have equal lengths. Second support pins 16 operate on an outside portion of plungers 22, distant from vertical surface 9.

As crank shaft 20 operates, the eccentric part transmits the rotation to the large end of connecting rod 21. The driving motion of connecting rod 21 transmits the motion to center support point pin 18 through the small end of connecting rod 21 and upper links 12 operate. Crank shaft 20 operates through a complete circle having 360 degrees (the crank angle) relative to vertical surface 9. Crank shaft 20, connects to fly wheel 6 through the disconnecting clutch.

As crank shaft 20 rotates in the direction of the arrow, the eccentric part pushes connecting rod 21 in an up-down motion. As connecting rod 21 actuates, connecting link 17 actuate upper toggle links 12 through first support point pins 14. When crank shaft 20 is rotated so that connecting rod 21 is at a crank angle of 185.5 degrees, slide 8 is at a bottom dead center position relative to bolster 7. It should be understood that a top dead position is defined opposite the bottom dead center position, at substantially 0 or 360 crank angle degrees. During continuous operation, slide 8 is at the bottom dead center position once during each cycle.

Figure 4:
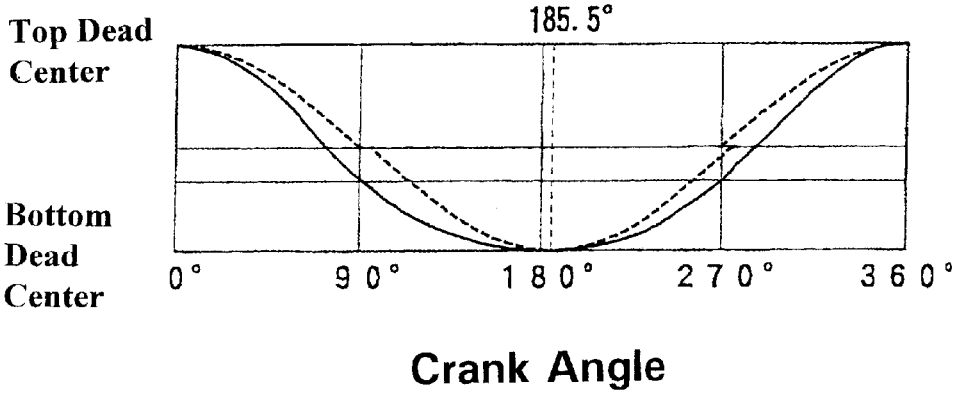
FIG. 4 is a figure showing the slide motion of a slide driving device.

The continuous motion of slide 8 is shown by the continuous line in FIG. 4. At crank angles of 90 and 290 degrees, slide driving mechanism 2 is at a ⅓ stroke position. For comparison purposes only a standard sine wave, which is partially shifted, is shown by the dashed line. It should be understood, that the speed of slide 8 slows near the bottom dead center position at 185.5 degrees. It should be further understood that the above described embodiment is only a first embodiment of the present invention and many other embodiments are possible.

Figure 5:
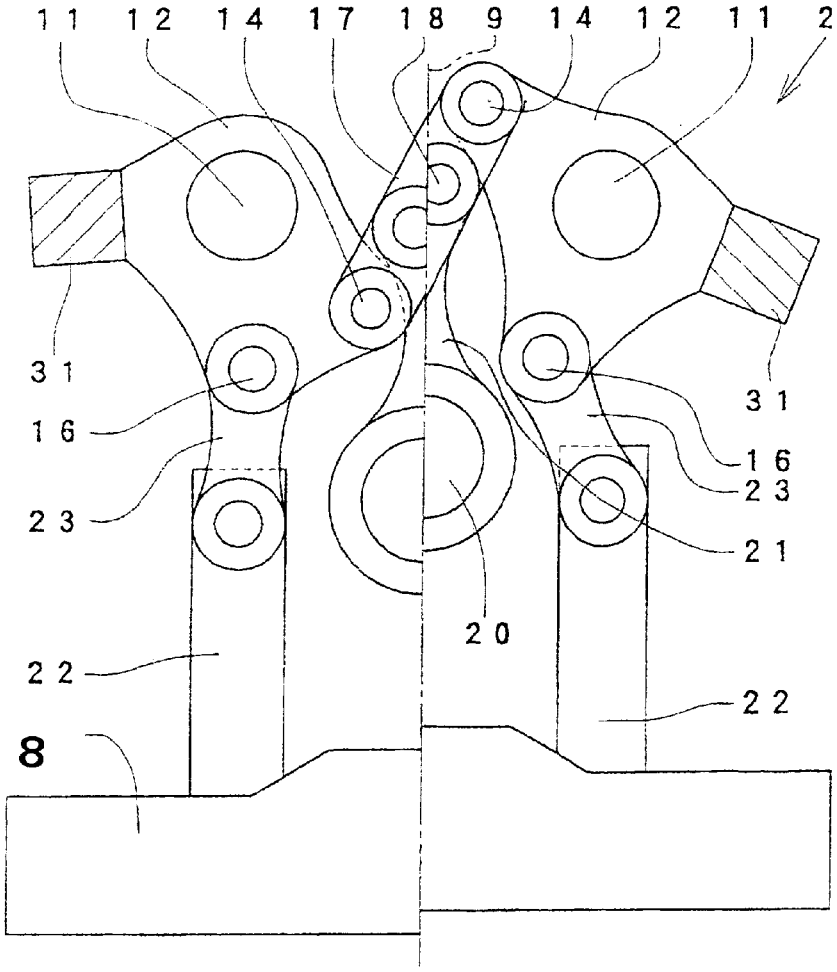
FIG. 5 is a front view showing a slide driving device of a second embodiment of the present invention.

Additionally referring now to FIG. 5, showing a second embodiment of slide driving device 2. In the right portion of FIG. 5, slide 8 is at the top dead center position. In the left portion of FIG. 5, slide 8 is at the bottom dead center position. In this embodiment, second support point pins 16 operate on the inner side of plungers 22 relative to vertical surface 9. It is to be understood that dynamic balancers 31 may additionally form a shape, or having a weight, adapted to compensate for the operating forces in this second embodiment.

Figure 6:
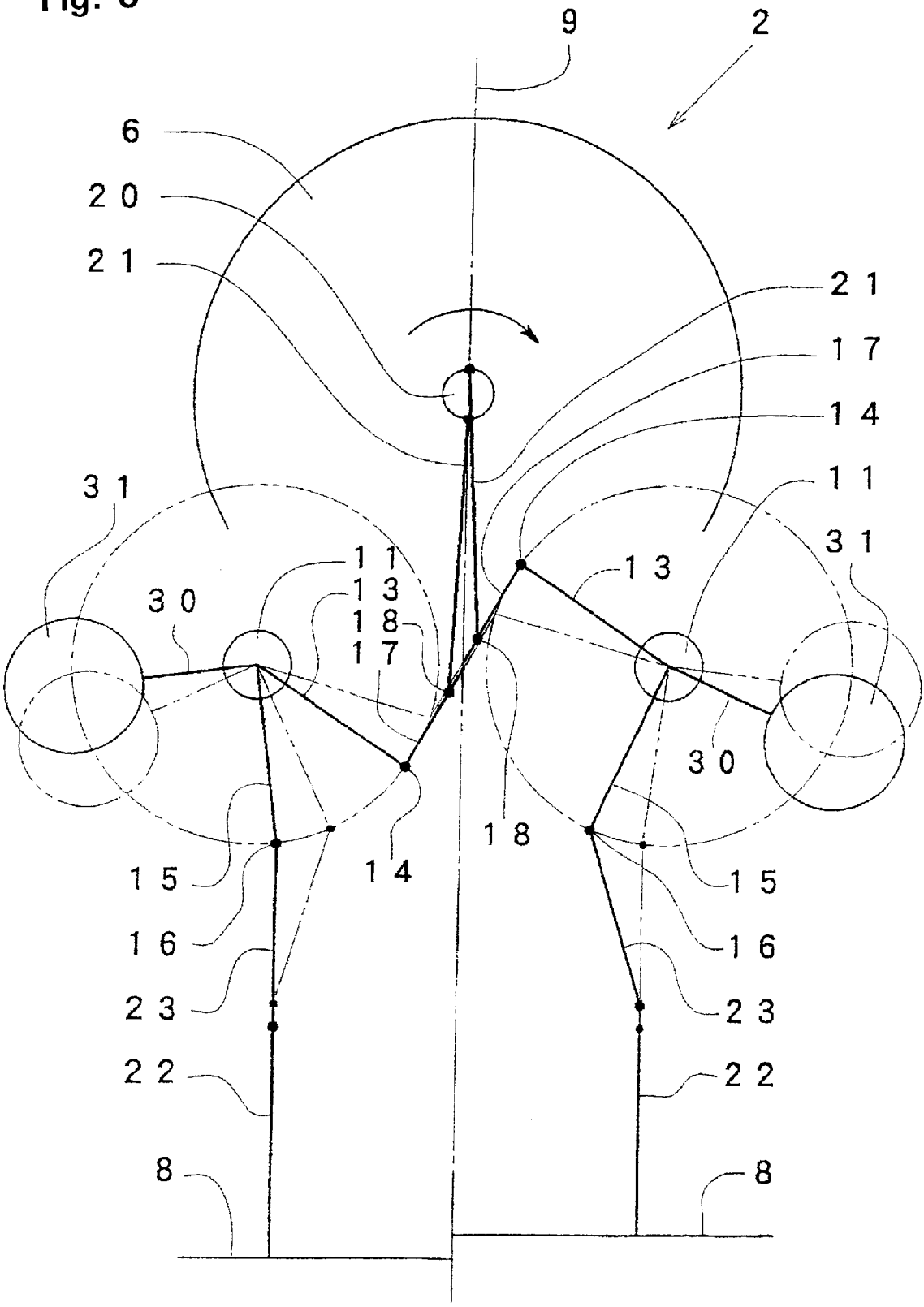
FIG. 6 is a front view of a slide driving device of a third embodiment of the present invention.

Additionally referring now to FIG. 6, showing a third embodiment of slide driving device 2. The right portion of the figure shows slide 8 at the top dead position and the left portion of the figure shows slide 8 at the bottom dead center position. In this embodiment, crank shaft 20, fly wheel 6, and connecting rod 21 are positioned above center support point 18, and connecting link 17.

Figure 7:
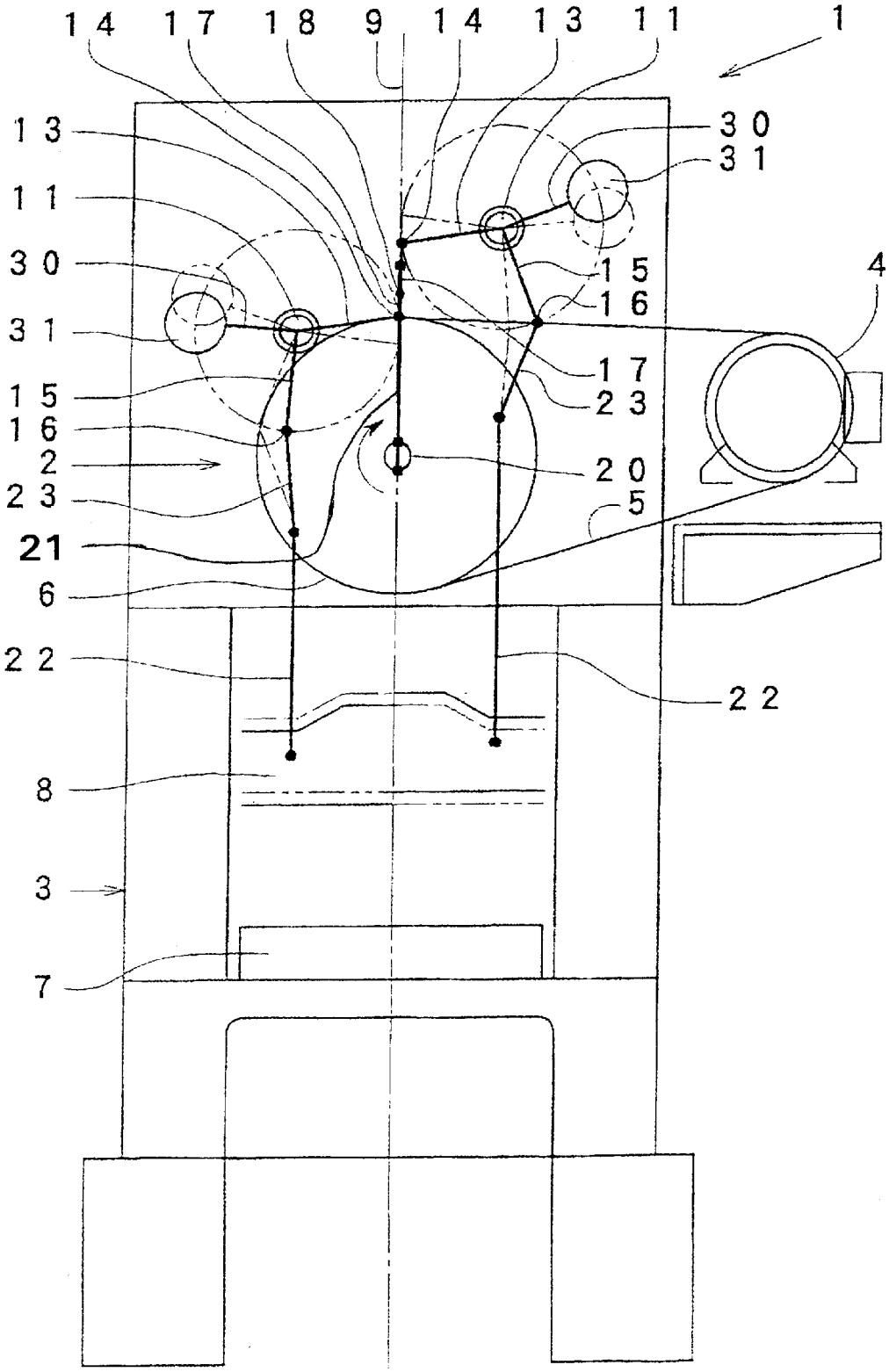
FIG. 7 is a front view of a press machine of a fourth embodiment of the present invention.

Additionally referring now to FIG. 7, showing a fourth embodiment of slide driving device 2 and press machine 1. Again, the right portion of the figure shows slide 8 at the top dead center position, and the left portion of the figure shows slide 8 at the bottom dead center position.

In this embodiment, the positions of fixed support point pins 11 are at different relevant heights. Plungers 22 have differing respective lengths to position slide 8 horizontally to bolster 7. Connecting link 17 moves substantially vertically, along vertical surface position 9, and the side-to-side swinging of connecting rod 21 is minimized. Since the swinging of connecting rod 21 is minimized, one vibration source is minimized.

Figure 8:
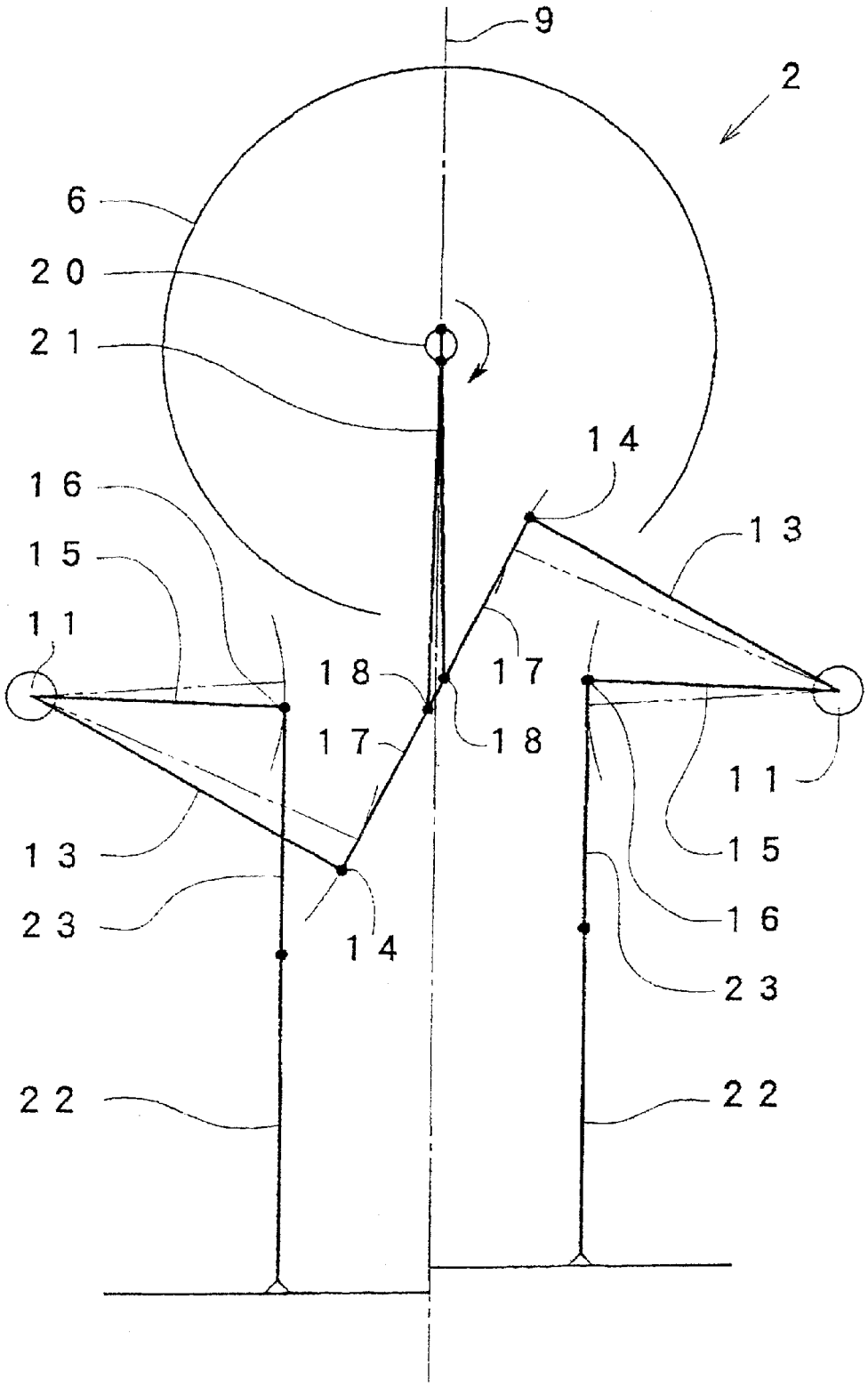
FIG. 8 is a front view of a slide driving device of a fifth embodiment of the present invention.

Additionally referring now to FIG. 8, showing a fifth embodiment of slide driving device 2 according to the present invention. Again, the right portion of the figure shows slide 8 at the top dead center position, and the left portion of the figure shows slide 8 at the bottom dead center position.

In this embodiment crank shaft 20, fly wheel 6, and connecting rod 21 are positioned above center support point pin 18. Fixed support point pins 11 are positioned horizontally distant from and vertically above plungers 22. Second links 15, are repositioned relative to plungers 22, such that second support point pins 16 are substantially positioned directly above plungers 22 during operation.

Since, the distance between left and right support point pins 11 is larger, the lengths of first links 13 are longer than the lengths of second links 15. The swinging angle of second links 15 is small relative to the swinging angle of first links 13. Thus, second support point pins 16 move generally vertically relative to plungers 22 and lower toggle links 23 are made unitary with plungers 22. It is to be understood, that due to the minimal horizontal movement of second support points 16, plungers may be rotatively fixed to second support points 16, thereby simplifying construction.

In this fifth embodiment, the movement of slide 8 remains an approximate sine curve, but since there is no longer a lower toggle link 23 effect there is no reduction in speed near the bottom dead center position.

It is to be understood that, while in each of the above embodiments the small end of connecting rod 21 connects with center support point pin 18 at a midpoint of connecting link 17, the invention may also be implemented by connecting along either side of connecting link 17 or either upper toggle link 12.

It is to be further understood that by forming a Watt-link-type mechanism, the parallelism of slide driving device 2 may be maintained. The parallelism is maintained by connecting first support point pins 14 of each upper toggle link 12 through a single connecting link. Since the single connecting link involves pin-type connections (or similar simplified connections), construction is simplified and high precision in construction is achievable.

It is to be further understood that the placement, weight, and shape of dynamic balancers 31, positioned on upper toggle links 12, act to minimize and suppress the operating vibration of press machine 1. As a result, press machine 1 may be simply constructed with smaller parts, thus reducing construction time and cost.

It is to be further understood that crank shaft 20 may be positioned near the center of press machine 1, thus reducing the total height of press machine 1, increasing operational stability, and allowing narrower or wider spacing between plungers 22 according to customer need.

It is to be further understood, that crank shaft 20 may be positioned above upper toggle links 12, thus allowing a shorter length for plungers 22, simplifying movement, and maintaining operational parallelism.

It is to be further understood, that the distance between upper toggle links 12 may be increased so that the swing angle of second links 15 is small compared to the swing angle of first links 13. Since the second support point pins 16 move substantially vertically, plungers 22 may be made unitary with lower toggle links 23. As a result, parallelism is easily maintained and the connecting parts may be simplified thus reducing costs and allowing increased precision.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A slide driving device comprising:

at least first and second upper toggle means;

a first rotation center on said first upper toggle means;

a second rotation center on said second upper toggle means;

each of said first and second rotation centers permitting each of said first and second upper toggle means to rotate in an arc;

a first point pin on each said first and second upper toggle means;

a left first link connecting said first rotation center to said first point pin on said first upper toggle means;

a right first link connecting said second rotation center to said first point pin on said second upper toggle means;

a connecting link connecting said first and second upper toggle means at said first point pins on a common inner tangent line to each said arc where said left and right first links are parallel;

a single connecting rod connected to said connecting link;

a first and second plunger for driving a slide in a cycle;

said first and second plungers operably connected to said first and second upper toggle means;

said connecting link being effective to transfer a linear guiding displacement to said first and second upper toggle means; and said first and second upper toggle means transferring said linear guiding displacement to said plungers whereby said slide operates through said cycle.

2. A slide driving device according to claim 1, further comprising:

a crank shaft; and said connecting rod having an eccentric displacement connected to said connecting link;

wherein said connecting rod operably transfers said eccentric displacement to said connecting link whereby said slide operates through said cycle.

3. A slide driving device according to claim 2, further comprising:

a second point pin on each said first and second upper toggle means;

a left second link connecting said first rotation center to said second point pin on said first upper toggle means;

a right second link connecting said second rotation center to said second point pin on said second upper toggle means;

at least first and second lower toggle means;

said first and second lower toggle means operably connected to respective said first and second plungers; and said first and second upper toggle means operably transferring said linear guiding displacement through said left and right second links to respective said first and second lower toggle means and said slide whereby said slide operates through said cycle.

4. A slide driving device, according to claim 3, wherein:

said first and second upper toggle means operably transfer said linear guiding displacement from said connecting link to each said respective second link, whereby said slide operates through said displacement cycle.

5. A slide driving device, according to claim 3, wherein:

each of said left and right first links have a first length and each of said left and right second links have a second length;

said first length is approximately equal to said second length;

said first upper toggle means has a first arc radius, and said second upper toggle means has a second arc radius;

said first arc radius is approximately equal to said second arc radius;

each of said first and second rotation centers is located above each respective said plunger;

each of said first and second rotation centers is equidistant from a common center line between said first and second upper toggle means;

said crank shaft is located below said connection rod; and said second support pins and said first and second lower toggle means are operable on the outer sides of each respective said plunger, whereby said slide operates through said displacement cycle.

6. A slide driving device according to claim 3, wherein:

said first and second links have the same length;

said arc for each respective said first and second upper toggle means has the same radius;

each said rotation center above each respective said plunger;

each said rotation center equidistant from a common center line between said first and second upper toggle means;

said crank shaft below said connection rod; and said second support pins and said first and second lower toggle links operable on an inner side of each respective said plunger, whereby said slide operates through said displacement cycle.

7. A slide driving device according to claim 3, wherein:

said first and second links have the same length;

said arc for each respective said first and second upper toggle means has the same radius;

each said rotation center above each said plunger;

each said rotation center equidistant from a common center line between said first and second upper toggle means;

said crank shaft above said connection rod; and said second support pins and said first and second lower toggle links operable on an inner side of each respective said plunger, whereby said slide operates through said displacement cycle.

8. A slide driving device according to claim 3, wherein:

each said rotation center is a first distance from a common center line between said first and second upper toggle means;

each said plunger is a second distance from said common center line;

said first distance greater than said second distance;

each said first link longer than each said second link;

each said second point pin operable substantially above each respective said plunger and respective said toggle link;

said crank shaft above said connection rod along said common center line; and each said lower toggle link and each respective said plunger being substantially unitary and operable parallel to said common center line, whereby said slide operates through said displacement cycle with reduced vibration.

9. A slide driving device according to claim 5, wherein:

first rotation center and said second rotation center at different distances above each respective said plunger;

said first point pins substantially tangent said common center line; and said connecting rod and said connecting link operate substantially along said common center line and minimize vibration in said slide driving device when said first and second plungers drive said slide in said displacement cycle.

10. A slide driving device comprising:

a first and second upper toggle means;

said first and second upper toggle means being equidistant from a common center line;

said first and second upper toggle means being operable in first and second arcs;

a connecting link operably joining said first and second upper toggle means at an inner tangent line to said first and second arcs; a single connecting rod connected to said connecting link a first and second lower toggle means;

said first and second lower toggle means operably joined to respective said first and second upper toggle means;

a slide element operable by said first and second lower toggle means in a displacement cycle;

said connecting link receives a driving displacement; and said first and second upper toggle means transmit said driving displacement to said first and second lower toggle means and said slide element and said slide operates in said displacement cycle to minimize vibration.

11. A slide driving device for a press machine, comprising:

a left and a right upper toggle link equidistant from a common center;

said left and right upper toggle links pivotably mounted on respective fixed support point pins;

a first support link on each said left and right upper toggle links;

each said first support link being operable in an arc;

each said first support links having equal lengths;

a connecting link operably connecting each said first support links along a common inner tangent line to each said arc when said first support links are parallel to each other;

a single connecting rod connecting said connecting link to an eccentric portion on a crank shaft;

first and second lower toggle links connecting second support point pins on said left and right upper toggle links along a second link;

said second links located on each said left and right upper toggle link;

said second links rotatably connected to said left and right lower toggle links and to at least left and right points on a slide; and said connecting rod transmitting a linear guiding displacement to said left and right upper toggle links and said lower toggle links, to said slide to drive said slide through a displacement cycle.

12. A slide driving device for a press machine, according to claim 11, further comprising:

a left and right plunger upright at left and right points of said slide;

a first end of each said left and right plungers operably connect to respective said left and right lower toggle links;

said left and right fixed support points horizontally equidistant from said center line above respective said left and right plungers;

said second support point pins on an outer side of each said left and right plunger; and said crank shaft is below said connecting link.

13. A slide driving device for a press machine, according to claim 11, further comprising:

a left and right plunger upright at left and right points of said slide;

a first end of each said left and right plungers operably connect to each respective said left and right lower toggle links;

said left and right fixed support points equidistant from said common center line above each respective said left and right plunger;

said second support point pins on inner sides of each respective said left and right plunger; and said crank shaft below said connecting link.

14. A slide driving device for a press machine, according to claim 11, further comprising:

a left and right plunger upright at left and right points of said slide;

first ends of each said left and right plunger operably connect to each respective said left and right lower toggle link;

said left and right fixed support points equidistant from said center line and outward from directly above said plungers;

said second support point pins on inner sides of each respective said left and right plunger; and said crank shaft is above said connecting link.

15. A slide driving device for a press machine, according to claim 11, further comprising:

a left and right plunger upright at left and right points of said slide;

first ends of said left and right plungers operably connect to each respective said left and right tower toggle link;

said left and right fixed support points at first and second positions;

said first and second positions above each said left and right plunger at different distances;

said second support point pins on outer sides of each respective said left and right plunger; and said crank shaft is placed below said connecting link.

16. A slide driving device for a press machine, according to claim 11, further comprising:

said left and right fixed support points are horizontally equidistant from said center line outward from each respective said left and right points of said slide;

said second links perpendicular to said center line when each respective said second support point pin is directly above each respective said left and right points on said slide; and said crank shaft is above said connecting link.

* * * * *